US008695689B2

(12) United States Patent
Kohl et al.

(10) Patent No.: US 8,695,689 B2
(45) Date of Patent: Apr. 15, 2014

(54) HEAT EXCHANGER, IN PARTICULAR HEATER FOR MOTOR VEHICLES

(75) Inventors: Michael Kohl, Bietigheim (DE); Miriam Lozano-Aviles, Moeglingen (DE); Thomas Strauss, Notzingen (DE)

(73) Assignee: Behr GmbH & Co. KG, Stuttgart (DE)

( * ) Notice: Subject to any disclaimer, the term of this patent is extended or adjusted under 35 U.S.C. 154(b) by 675 days.

(21) Appl. No.: 12/796,012

(22) Filed: Jun. 8, 2010

(65) Prior Publication Data

US 2011/0036546 A1 Feb. 17, 2011

Related U.S. Application Data

(63) Continuation of application No. PCT/EP2008/009271, filed on Nov. 4, 2008.

(30) Foreign Application Priority Data

Dec. 10, 2007 (DE) ..... 10 2007 059 672
Apr. 3, 2008 (DE) ..... 10 2008 017 485

(51) Int. Cl.
*F28D 1/053* (2006.01)
*F28F 9/22* (2006.01)
*F28F 9/02* (2006.01)

(52) U.S. Cl.
CPC ..... *F28D 1/05391* (2013.01); *F28F 9/0204* (2013.01); *F28F 9/22* (2013.01)
USPC ..... 165/174; 165/176

(58) Field of Classification Search
USPC ..... 165/146, 174
See application file for complete search history.

(56) References Cited

U.S. PATENT DOCUMENTS

| | | | | |
|---|---|---|---|---|
| 1,993,095 | A | 3/1935 | Heinrich | |
| 5,186,248 | A * | 2/1993 | Halstead | 165/173 |
| 5,205,347 | A * | 4/1993 | Hughes | 165/176 |
| 5,579,835 | A * | 12/1996 | Chiba et al. | 165/174 |
| 5,685,366 | A * | 11/1997 | Voss et al. | 165/144 |
| 5,941,303 | A * | 8/1999 | Gowan et al. | 165/176 |
| 6,749,015 | B2 * | 6/2004 | Moreau | 165/174 |
| 2003/0041610 | A1 | 3/2003 | Shirota et al. | |
| 2004/0256091 | A1 | 12/2004 | Higashiyama | |
| 2005/0172664 | A1 * | 8/2005 | Cho et al. | 62/515 |
| 2005/0205244 | A1 * | 9/2005 | Kaspar | 165/110 |
| 2005/0274506 | A1 * | 12/2005 | Bhatti et al. | 165/177 |
| 2008/0023182 | A1 * | 1/2008 | Beamer et al. | 165/137 |
| 2008/0035305 | A1 | 2/2008 | Wolk | |

FOREIGN PATENT DOCUMENTS

| | | |
|---|---|---|
| DE | 38 13 339 A1 | 11/1989 |
| DE | 43 09 360 A1 | 9/1994 |
| DE | 4431107 C1 | 2/1996 |

(Continued)

*Primary Examiner* — Allen Flanigan
(74) *Attorney, Agent, or Firm* — Muncy, Geissler, Olds & Lowe, P.C.

(57) ABSTRACT

A heat exchanger is provided that comprises at least two rows of low channels through which a liquid medium can flow, and secondary surfaces arranged between the flow channels and over which air flows, the liquid medium and the air being circulated in the cross-counterflow and the first row being arranged on the air outlet side and the second row on the air inlet side. According to the invention, the liquid medium enters a first region of the first row, is deflected into a second region inside the first row, and from the second region of the first row into the second row.

15 Claims, 12 Drawing Sheets

(56) References Cited

FOREIGN PATENT DOCUMENTS

| | | | |
|---|---|---|---|
| DE | 198 00 487 | A1 | 7/1999 |
| DE | 101 43 092 | A1 | 3/2003 |
| DE | 102 47 609 | A1 | 4/2004 |
| DE | 10 2004 005 621 | A1 | 8/2005 |
| DE | 10 2005 048 227 | A1 | 4/2007 |
| DE | 603 06 291 | T2 | 5/2007 |
| EP | 0 599 107 | A2 | 6/1994 |
| EP | 0 802 383 | A2 | 10/1997 |
| EP | 1 460 363 | A2 | 9/2004 |
| FR | 1.265.756 | | 6/1961 |
| FR | 2 780 152 | A1 | 12/1999 |
| FR | 2 803 378 | A1 | 7/2001 |
| FR | 2 914 407 | A1 | 10/2008 |

* cited by examiner

L
23
29
28
31
30
27
26
26a
26b
26c
a
b1
b2
c
B
T
T1
T2

HEAT EXCHANGER, IN PARTICULAR HEATER FOR MOTOR VEHICLES

This nonprovisional application is a continuation of International Application No. PCT/EP2008/009271, which was filed on Nov. 4, 2008, and which claims priority to German Patent Application No. DE 102007059672.5, which was filed in Germany on Dec. 10, 2007, and to German Patent Application No. DE 102008017485.8, which was filed in Germany on Apr. 3, 2008, and which are all herein incorporated by reference.

BACKGROUND OF THE INVENTION

1. Field of the Invention

The present invention relates to a heat exchanger.

2. Description of the Background Art

Heat exchangers, in particular heaters for motor vehicles, have a liquid medium, such as coolant, flowing through them on the primary side, and are exposed on the secondary side to ambient air that is delivered to the passenger compartment. Conventional heaters have a block having tubes and ribs. The air to be heated enters this block and exits it again at its rear. A problem in heating the air in the heater block is that the outlet air temperatures at the air outlet area are not the same everywhere, so that strands of differing air temperature occur. This is a disadvantage for controlled heating of the interior.

A variety of flow patterns are known for flow through a heater, which is generally designed with multiple rows or multiple flows, with the simplest form being parallel flow in which flow passes through all tubes in the same direction. Also known is a U-shaped flow through the heater in which a baffle (transverse baffle) is located in a header tank. Since this redirection of the coolant takes place transverse to the direction of air flow, it is referred to as redirection "across the width." With respect to the two media flows, coolant and air, this is called a cross-flow. The coolant cools off on the way from the coolant inlet to the coolant outlet, so that the air at the half of the heater on the inlet side is heated more than that on the outlet side half, resulting in the aforementioned strand effect. It is also known to direct the coolant in the parallel direction or counterflow direction to the airflow, in other words the coolant is redirected from one row into the adjacent row in a multiple-row heater. This requires a longitudinal baffle, which separates adjacent rows on one side. This is referred to as redirection "over depth." Depending on whether the redirection takes place in or opposite to the direction of airflow, this is referred to as parallel flow or counterflow. It is known that better efficiencies can be achieved with counterflow. It is a disadvantage, in particular for relatively wide heaters, that the coolant at the inlet side must be distributed over the full width; this can have the result that flow through the outer tubes is slower with a central coolant inlet, which likewise has an unfavorable effect on the outlet air temperature.

DE 10 2005 048 227 A1, which is incorporated herein by reference, discloses a heater with flat tubes in which the coolant is directed in cross-counterflow to the airflow, which is to say that a redirection in depth takes place towards the air inlet side. In another variant that is not shown and is not described in detail, a redirection in the width is additionally provided.

DE 102 47 609 A1 describes a heater in which the coolant is redirected exclusively in width, and specifically in multiple stages, with multiple coolant flows being connected in parallel. The purpose of this arrangement is to achieve relatively high pressure drops at the redirection points of the water tanks through turbulence of the coolant.

DE 44 31 107 C1 discloses a heater for motor vehicles which operates according to the counterflow principle. In this concept, the coolant is redirected from the air outlet side towards the air inlet side in one or more stages. Better heat-transfer performance can be achieved in this way.

DE 603 06 291 T2 (corresponding to EP 1 410 929 B1) discloses a heater for motor vehicles with separate control of the right and left sides (driver's side and passenger's side) of the passenger compartment. In this concept, the coolant is delivered through two supplies, is redirected to the middle in width, and is removed there through a common return. In a special embodiment (FIG. 8), a redirection in depth is provided in addition to the redirection in width, specifically opposite the direction of airflow. In the so-called left/right control, the airflow exiting the heater is split by a baffle into two partial streams, which are directed toward the left and right sides of the passenger compartment.

SUMMARY OF THE INVENTION

It is therefore an object of the present invention to create the most homogeneous possible outlet air temperature profile in a heat exchanger of the initially mentioned type.

In an embodiment of the invention, in a cross-counterflow heat exchanger the liquid medium (coolant) enters a first region, the inlet region, and in this row on the air outlet side is redirected into a second region, with both the first and second regions having subregions. In other words, the coolant entering the first row of flow channels can be redirected at least once in width. The coolant is then redirected from the first row into the second row, i.e. the row on the air inlet side, with flow through all flow channels in the second row being in the same direction. The inventive coolant routing by means of redirections in width and depth achieves the advantage that a largely homogeneous temperature profile is produced at the air outlet side.

In an embodiment, the coolant can be also redirected at least once in the second row as well, which is to say in the windward row. In all, the coolant flow is thus redirected twice in width and once in depth. As a result of the opposite coolant flow in the two rows of tubes, the outlet air temperature profile can be homogenized still further.

According to a first aspect of the invention, the inlet region can be located in the center of the first row, while the second region comprises two subregions that are symmetrically arranged next to the first region. The incoming coolant flow is thus divided after the first pass and redirected in opposite directions in the width of the heat exchanger. Subsequently, the coolant flows exiting the two subregions are redirected in depth and distributed over the second row such that flow passes through all flow channels in the same direction. In this way, a symmetrical outlet air temperature profile is achieved, which is to say that any deviations from a homogenous temperature distribution occur symmetrically. Alternatively, redirection in the second row can also take place in width.

According to a second aspect of the invention, the inlet region is located off-center in the first row, preferably in a first half, while the second region is located next to the first region. The coolant here flows into the first half of the row in the heat exchanger, is redirected in width, and the entire coolant flow enters the second region. From there, the redirection in depth and the distribution of the coolant flow over the entire second row take place in turn, wherein it is possible for flow through the latter to take place in the same direction or in different directions.

According to a third aspect of the invention, two inlet regions, which can be symmetrically arranged, are provided that communicate with one another through a connecting pipe. As a result, two flow branches are obtained on the inlet side, which are deflected inward in width, and enter the second region. This is followed by the redirection in depth and the distribution of the coolant over all the tubes of the second row. Alternatively, redirection in the second row can also take place in width, with a flow pattern similar to that in the first row.

The flow cross-sections in the first and second regions can be identical, which is to say that, in accordance with the known continuity equation, equal flow velocities result in the flow channels of the first and second regions, which is to say viewed across the full width. It is especially preferred, however, for the flow cross-section of the second region to be larger than that of the first region—with the result that a slowing of the flow takes place in the flow channels of the second region. This compensates for the cooling of the liquid medium, so that one obtains a homogeneous outlet air temperature distribution as an advantage.

In another embodiment, the flow cross-section in the second row can be matched to the flow cross-section of the second region in the first row, namely in such a manner that the entire flow cross-section of the second row is either identical to or larger than the entire flow cross-section of the second region. An expansion of the flow cross-section takes place due to the continued cooling of the liquid medium. In this way, either the same flow velocities can be achieved in the second row as in the first row, or even a delay in the flow—with the result that more heat can be dissipated to the air and a smaller pressure drop takes place. An expansion of the flow cross-section with resultant flow velocity can take place in the case of redirection in the width in the second row, as well.

According to an embodiment, the heat exchanger can be designed as a heater of a heating system for motor vehicles, which is to say the flow channels are designed as tubes, preferably as flat tubes or multichamber tubes through which the coolant flows and between which are arranged, preferably, corrugated fins as secondary surfaces.

The flat tube cross-sections of the second row can have an equal, larger, or smaller depth as compared to the flat tubes of the first row, depending on the flow pattern. This results in an increase in the flow cross-section after the redirection in depth, with the result that the flow velocity of the coolant is reduced in the second row. A greater cooling of the coolant, and thus greater heat-transfer performance, is achieved in this way.

The heater can have collecting reservoirs or chambers, i.e., an inlet chamber through which the coolant enters, an outlet chamber through which the coolant exits, or a coolant inlet and outlet chamber or a redirecting chamber.

In order to implement the above-described flow pattern in a heater, baffles in the form of longitudinal and/or transverse baffles are located in the collecting reservoirs, dividing the collecting reservoirs into individual chambers. Preferably, the inlet region for the flow channels or flat tubes of the first region is divided by a longitudinal baffle and at least one transverse baffle in the inlet chamber. In contrast, the outlet chamber has one longitudinal baffle, so that the first and second rows are divided from one another and a redirection in width can take place in the first row. Furthermore, in the case of "double" redirection in width, transverse and longitudinal baffles can be arranged in an H shape.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein:

FIG. 2*b* is a flow model according to FIG. 1 in a schematic view from above;

DETAILED DESCRIPTION

Figure 1:
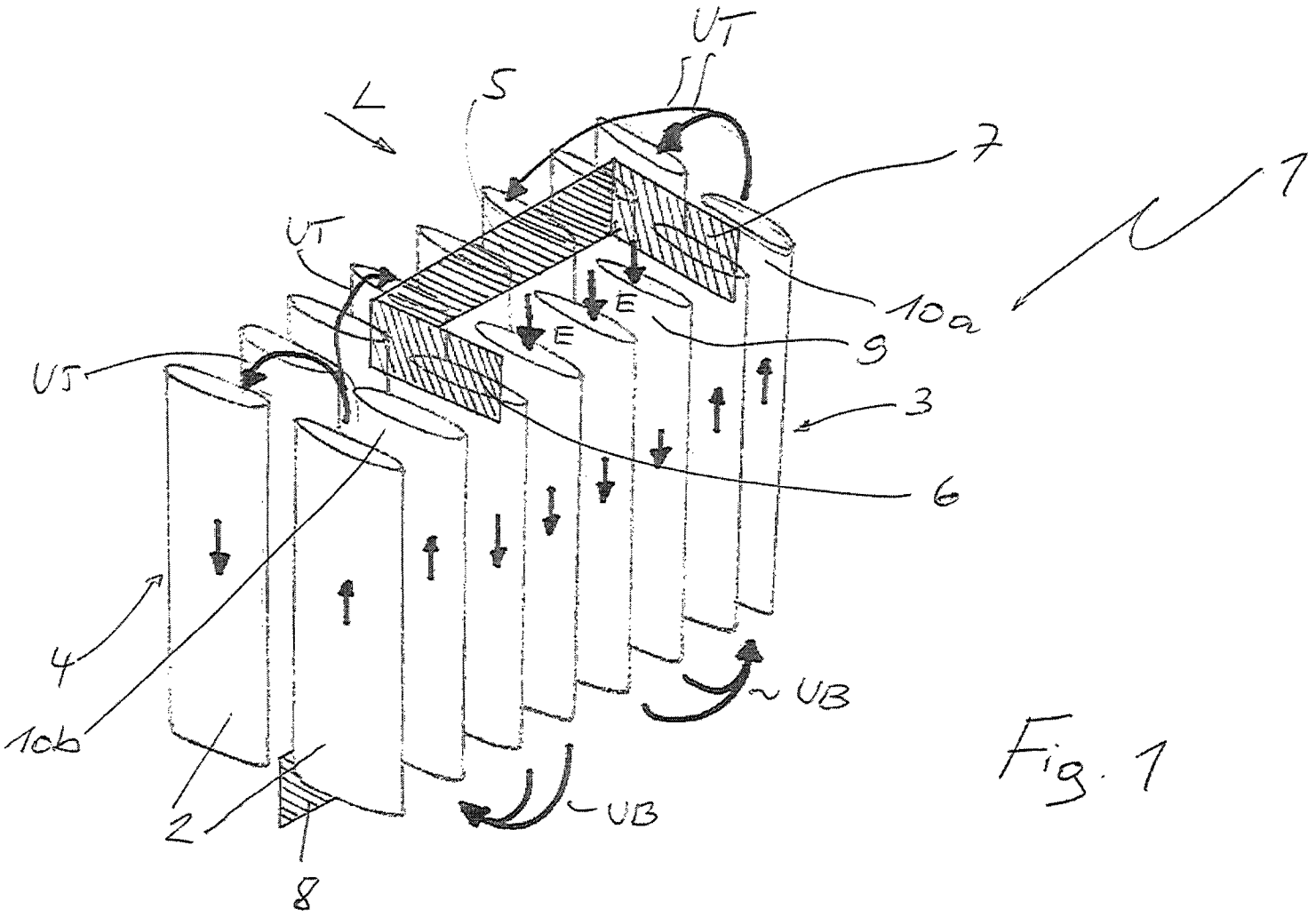
FIG. 1 is an exploded view of a heat exchanger with a two-part housing.
Figure 6B:
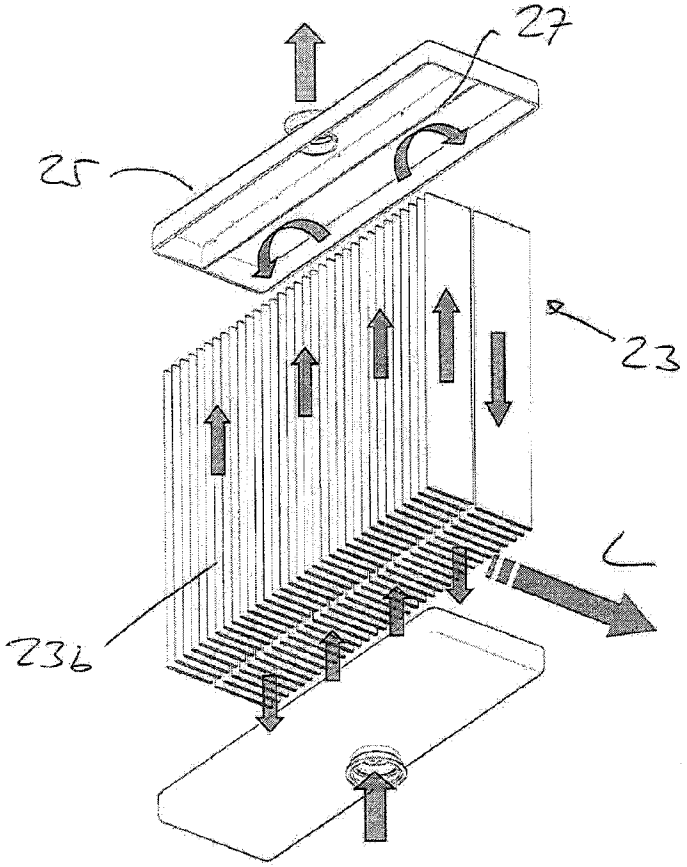
FIGS. 6*a*, 6*b* illustrate the heater with flow arrows in an exploded view facing the air inlet side and air outlet side.
Figure 6A:
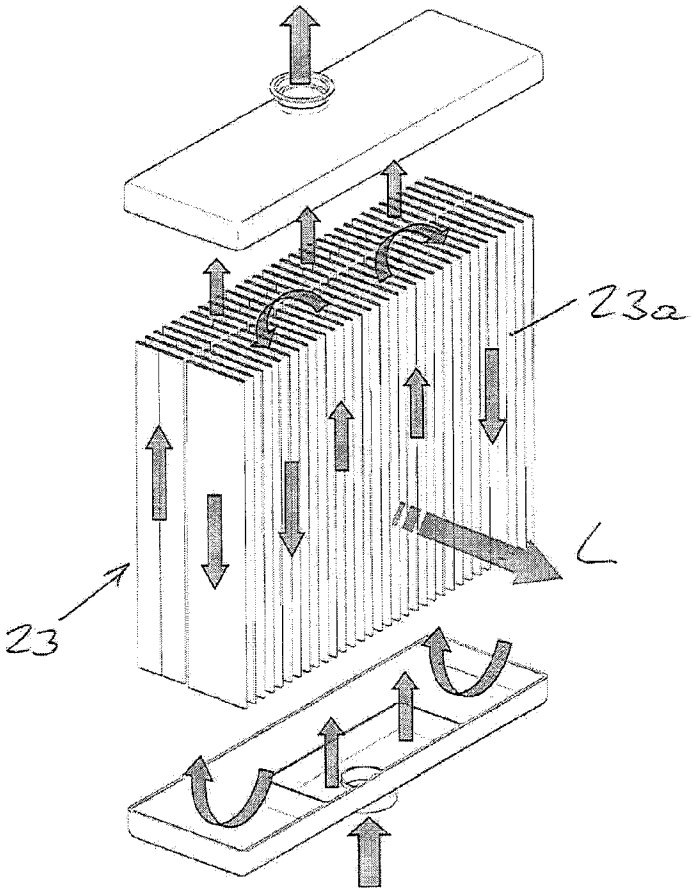

FIG. 1 shows a schematic representation of a first example embodiment of the invention, namely a flow model for a two-row heater 1, of which only tubes 2 (without fins) of a first row 3 and a second row 4 are shown. Also partially shown are a longitudinal baffle 5 with two transverse baffles 6, 7 in the inlet region of the tubes 2 and another, continuous, longitudinal baffle 8 in the lower region of the block 1. As indicated by flow arrows, coolant that is diverted from a coolant circuit (not shown) of an internal combustion engine of a motor vehicle passes through the tubes 2. The heater block 1 serves to heat air that flows through the block 1 as shown by the arrow L, and in so doing flows over ribs (not shown), referred to as secondary surfaces, between the tubes 2. The heated air is delivered to the passenger compartment of the motor vehicle. The first row 3 of the heater, hereinafter referred to as block 1 for short, is divided by the baffles 5, 6, 7 into three regions, with a first region 9 being located inside the baffles and 5, 6, 7 and a second region 10, encompassing two subregions 10*a*, 10*b*, being located on both sides of the transverse baffles 6, 7. In the example embodiment shown, the first region 9, also called the inlet region, encompasses four tubes 2, while the two subregions 10*a*, 10*b* each encompass two tubes 2. The coolant enters the tubes 2 through the inlet region 9 as shown by the arrows E, and flows through them from top to bottom (the terms top and bottom refer to the representation in the drawing). After the coolant exits the first region 9, the coolant flow is divided, redirected outward in each case within the first row 3, and then enters the tubes 2 of the subregions 10*a*, 10*b*, flowing through them from bottom to top. The redirection of the coolant is indicated by the arrows B, where UB designates redirection in width. After the coolant exits the tubes 2 of the two subregions 10*a*, 10*b*, a redirection in depth of both flow branches takes place, indicated by the arrows UT. The two flow branches redirected in depth are distributed over all tubes 2 of the second row 4 (eight in the example embodiment shown), flowing through them from top to bottom. This is followed by the exit of the coolant from the block 1. As is depicted in FIG. 6*a*, 6*b* that follow, the redirection of the coolant in width as indicated by the arrows UB is made possible by the continuous longitudinal baffle 8 in conjunction with a header tank that is not shown. The flow pattern described above corresponds to cross-counterflow with regard to the coolant and air flows. The first row 3 is the air outlet side row, hereinafter also called the leeward row for short, while the second row 4 is the air inlet side row, hereinafter also called the windward row. Thus, to summarize briefly, the coolant enters the block 1 in the leeward row 3, and is redirected first in width and then in depth, with flow passing through all tubes 4 of the windward side 4 in the same direction. This flow through the heater block 1 produces a maximally homogeneous outlet air temperature, which is to say after the air exits the first row 3.

FIG. 2*b* shows a schematic view of the heater block 1 according to FIG. 1 from above, facing the tubes 2, which are arranged in the two rows 3 and 4. The air flow is in turn indicated by an arrow L. The direction of flow of the coolant is indicated by dot symbols 11 and cross symbols 12, where the dot symbols 11 indicate a flow direction upward (out of the plane of the drawing), and the cross symbols 12 indicate a flow direction downward, i.e., into the plane of the drawing. The tubes 2 of the inlet region 9 are indicated with a brace a, the tubes 2 of the two subregions 10*a*, 10*b* are indicated with braces b1, b2, and the tubes 2 of the row 4 are indicated with a brace c. In this regard, the letters a, b1, b2, c represent the applicable number of tubes. The cross-sections of the tubes 2 are designed as flat tube cross-sections, and each have a depth T1 in the first row 3 and a depth T2 in the second row 4. The overall depth of the block 1 is labeled T. According to a preferred embodiment, the relationship a≤(b1+b2) applies. For the case in which b1+b2=a, the result is that the tubes 2 of the outer subregions 10*a*, 10*b* have the same flow velocity for the coolant as in the tubes 2 of the inlet region 9. However, on account of the cooling of the coolant, the flow cross-section for the second region is enlarged somewhat, so that a slowing of the coolant flow is achieved. This also contributes to a homogenization of the outlet air temperature profile. In the example embodiment shown, the number of tubes in the second row 4 matches the number of tubes in the first row 3, which is to say that a+b1+b2=c. If it were the case that T2=T1, the result would be a reduction of the coolant flow velocity by 50%. If T2=½ T1 were the case, the result would be equal coolant flow velocities in the two rows 3, 4. Depending on the cooling of the coolant, the preferred depth dimension T2 for the second row 4 lies in the range between 0.5 T1 and T1. The described flow model with redirections in depth and width thus makes it possible to reduce the flow velocity of the coolant in a stepwise manner by changing the flow cross-sections.

Figures 2, 2A:
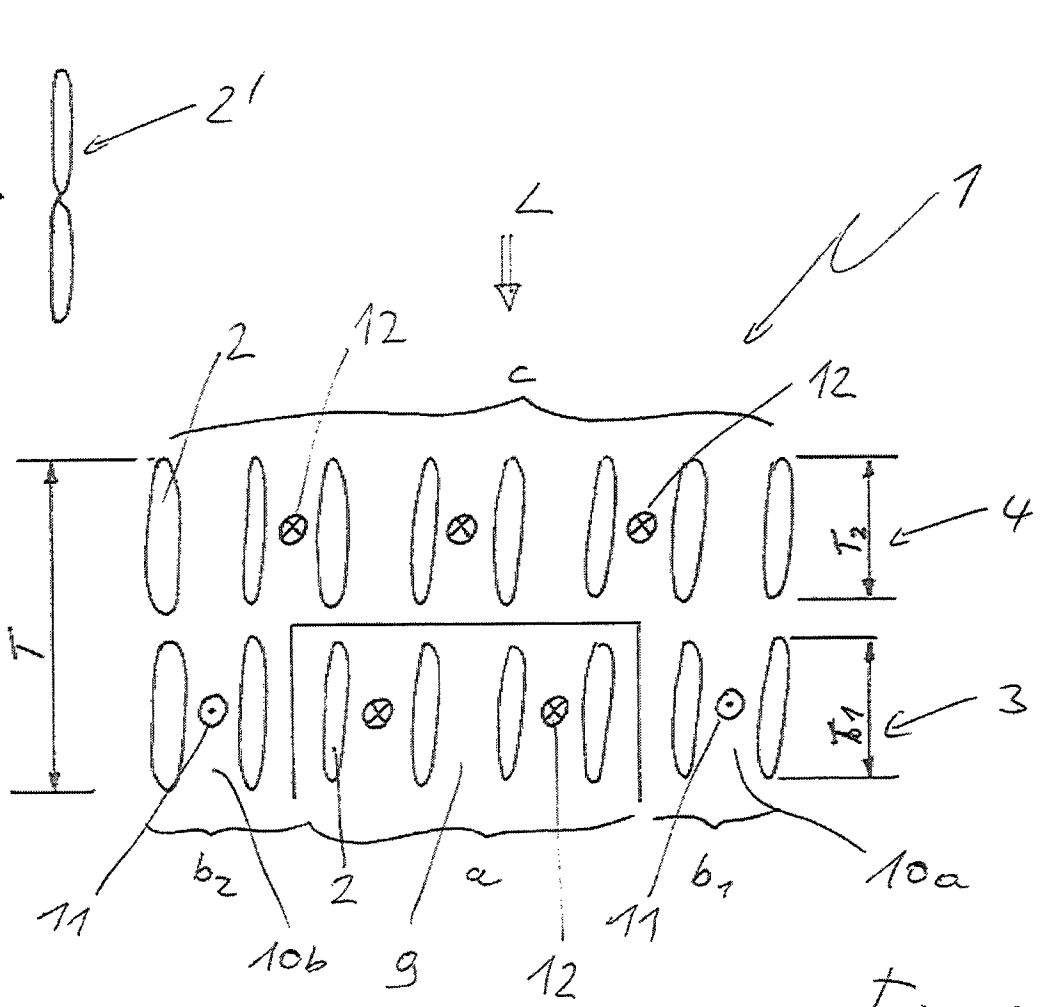
FIG. 2*a* illustrate example embodiments for shapes of tubes.

FIG. 2*a* shows two equivalent example embodiments of the tubes 2 mentioned above and shown, each of which has a flat tube cross-section. In principle, it is possible to use separate tubes 2 in different rows (two-row construction), or a two-chambered tube 2', i.e., a tube with two chambers (single-row construction).

Figure 3:
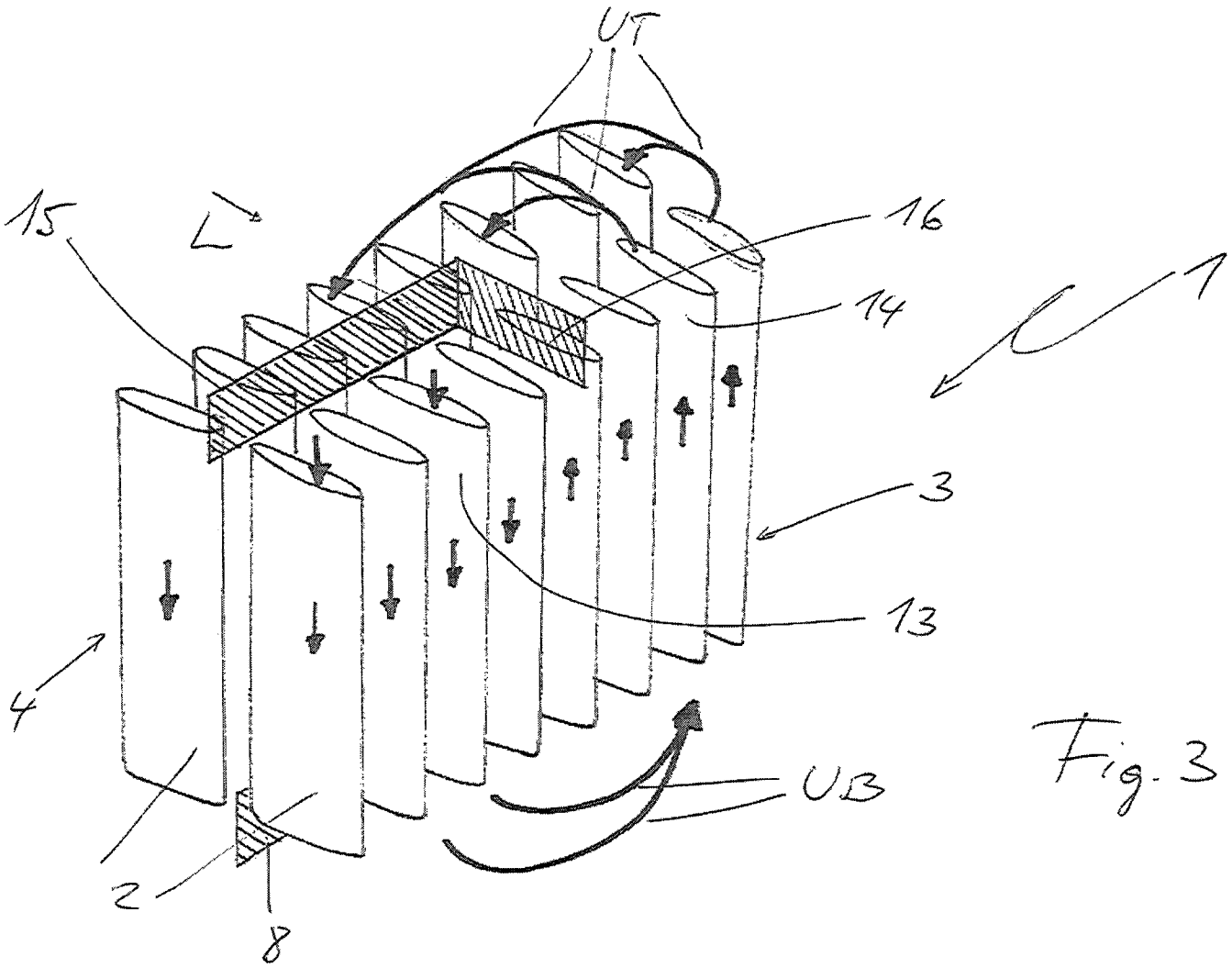
FIG. 3 is an example embodiment of the invention with off-center inlet region.

FIG. 3 shoes a second example embodiment of the invention, using the same reference symbols for the same parts. The block 1 has two rows 3, 4 of flat tubes 2, with the first row 3 being divided into a first region 13, the inlet region, and a second region 14. The inlet region 13 is divided by a longitudinal baffle 15 and a transverse baffle 16. The coolant enters the tubes 2 of the inlet region 13 as indicated by the arrows E, is subsequently redirected in width, i.e., within the row 3, as indicated by the arrow UB, and then flows through the tubes 2 of the second region 14 from bottom to top. The coolant is then redirected in depth as indicated by the arrow UT and distributed over all tubes 2 of the second row 4, through all of which it flows in the same direction from top to bottom. The coolant then exits the block 1. A homogeneous outlet air temperature distribution is also achieved with this flow pattern.

Figure 4:
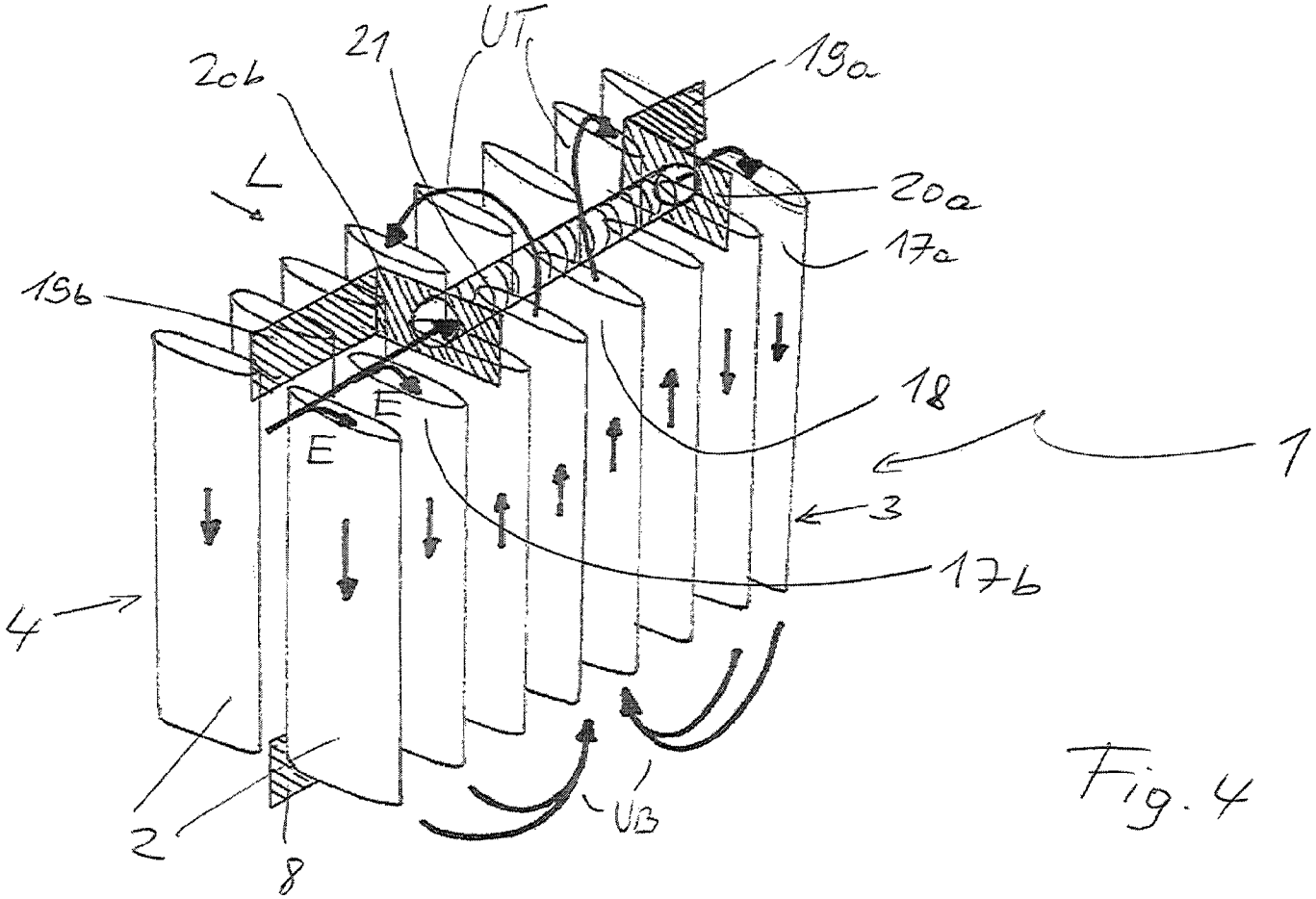
FIG. 4 an example embodiment of the invention with two inlet regions.

FIG. 4 shows a third example embodiment of the invention, with the same reference symbols again being used for the same parts. In contrast to the foregoing example embodiments, a first region 17 with two outer subregions 17*a*, 17*b* is provided here, as well as a central second region 18. The subregions 17*a*, 17*b* are each divided by longitudinal baffles 19*a*, 19*b* and transverse baffles 20*a*, 20*b*, between which a connecting pipe 21 is located. As indicated by the arrows E, the coolant enters the tubes 2 of the subregions 17*a*, 17*b*, in part through the connecting pipe 21, flows through them from top to bottom, is then redirected in width as indicated by the arrows UB, and flows through the central tubes 2 of the second region 18. There follows a redirection of the coolant flow in depth and a distribution over all tubes 2 of the second row 4, with flow passing through all of them in the same direction from top to bottom. This flow pattern guarantees a maximally homogeneous outlet air temperature profile.

Figure 5B:
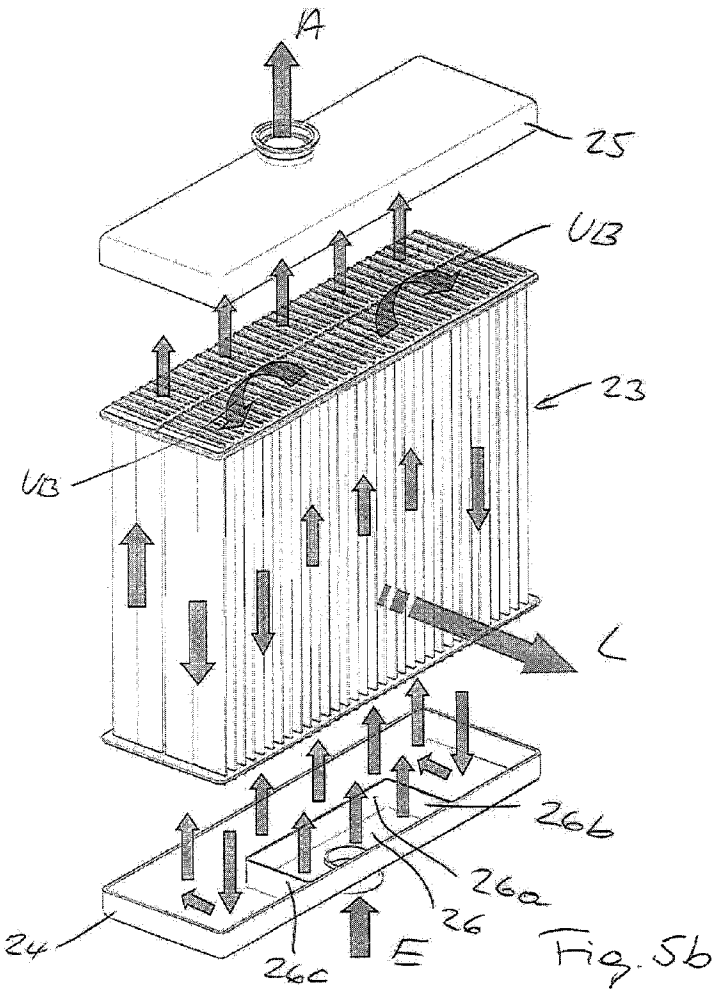
FIGS. 5*a*, 5*b* illustrate a heater with flow arrows, closed and in exploded view.
Figure 5A:
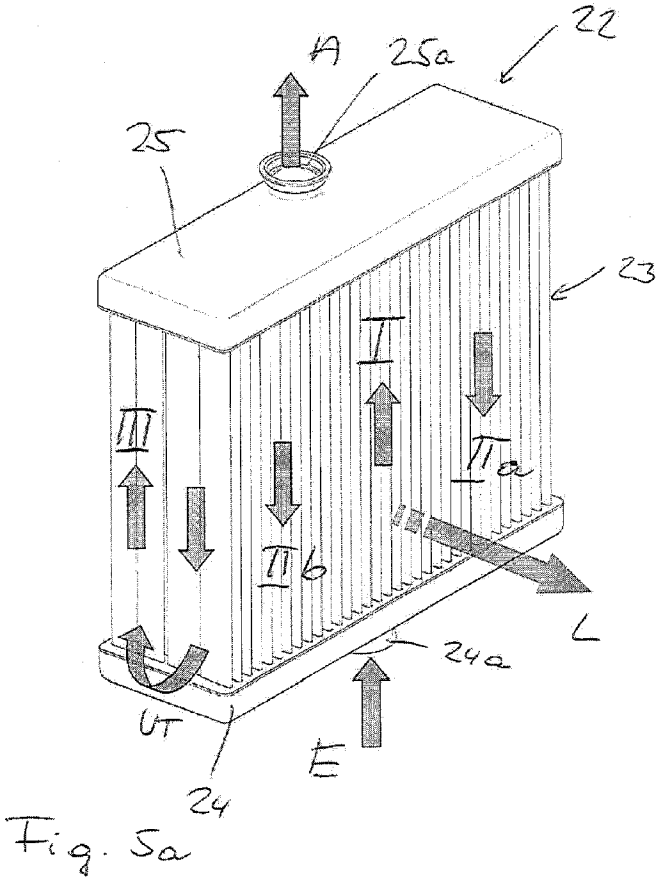

FIGS. 5*a* and 5*b* show a design embodiment of a heater 22 that corresponds to the first example embodiment from FIG. 1 and FIG. 2. However, there is the difference that the coolant inlet, indicated by an arrow E, is at the bottom, and the coolant outlet, indicated by an arrow A, is at the top. This depiction represents the preferred installation position of the heater 22 in the motor vehicle. The heater 22 comprises a heater block 23, also called the block for short, a bottom collecting reservoir or header tank 24, and a top collecting reservoir or header tank 25. The bottom collecting reservoir 24 has an inlet connection 24*a*, and the top collecting reservoir 25, also called the outlet chamber, has an outlet connection 25*a*. As shown and explained for the example embodiment according to FIG. 1 and FIG. 2, the block 23 comprises two rows of tubes, not provided with reference symbols here, through which flow passes as indicated by the arrows. The arrow I symbolizes the incoming coolant flow in the first region, the arrows IIa, IIb symbolize the flow branches redirected in width, and the arrow III symbolizes the coolant flow in the second, i.e. windward, row of tubes. The arrows UB, UT indicate the redirection of the coolant flow I in width and the redirection of the flow branch IIb in depth. The direction of flow of the air is indicated by an arrow L, which is to say that the heater block 23 is viewed from the air outlet side. The installation position of the heater 22 with the coolant outlet 25*a* at the top is chosen on account of better air bleeding of the heater 22.

FIG. 5*b* shows the heater 22 in an exploded view, which is to say that the lower inlet chamber 24, the upper outlet chamber 25, and the block 23 are shown separated from one another. As a result, the interior of the inlet chamber 24 is visible, in particular the inlet region 26 separated by one longitudinal baffle and two transverse baffles 26*a*, 26*b*, 26*c*. The coolant inlet flow in block 23 is indicated by three upward-pointing arrows. The redirection in width takes place as shown by the arrows UB (a longitudinal baffle that is not visible is located in the upper header tank 25 here). The redirection in depth takes place in the lower header tank 24 as shown by the arrows UT. The flow in the windward row is indicated by five upward-pointing arrows. As shown in FIG. 5*b*, the tubes in the rows are spaced along the width of the core. The tubes in the first row define first and second subsets. Also, the tubes in the first row and the tubes in the second row occupy given proportions of the width of the core, where the first subset of the first row occupies a first proportion of the width of the core, the second subset of the first row occupies a second proportion of the width of the core and the second row occupies a third proportion of the width of the core, such that a sum of the first proportion and the second proportion substantially equals the third proportion.

For clarification, FIG. 6*a* and FIG. 6*b* again show the heater 22 from FIGS. 5*a*, 5*b* in exploded views, specifically in FIG. 6*a* looking towards the air outlet side 23*a* and in FIG. 6*b* looking towards the air inlet side 23*b*. The flow direction of the air is indicated by arrows L in each view. Otherwise, identical reference numbers are used for identical parts. This representation makes clear the different flow on the leeward side 23*a* and on the windward side 23*b* of the heater block 23. In the first case coolant flow takes place in opposite directions, while it takes place in the same direction in the second case. Visible in FIG. 6*b* is a longitudinal baffle 27, which corresponds to the longitudinal baffle 8 in the example embodiments from FIG. 1 through FIG. 4.

Figures 7A, 7B, 7C:
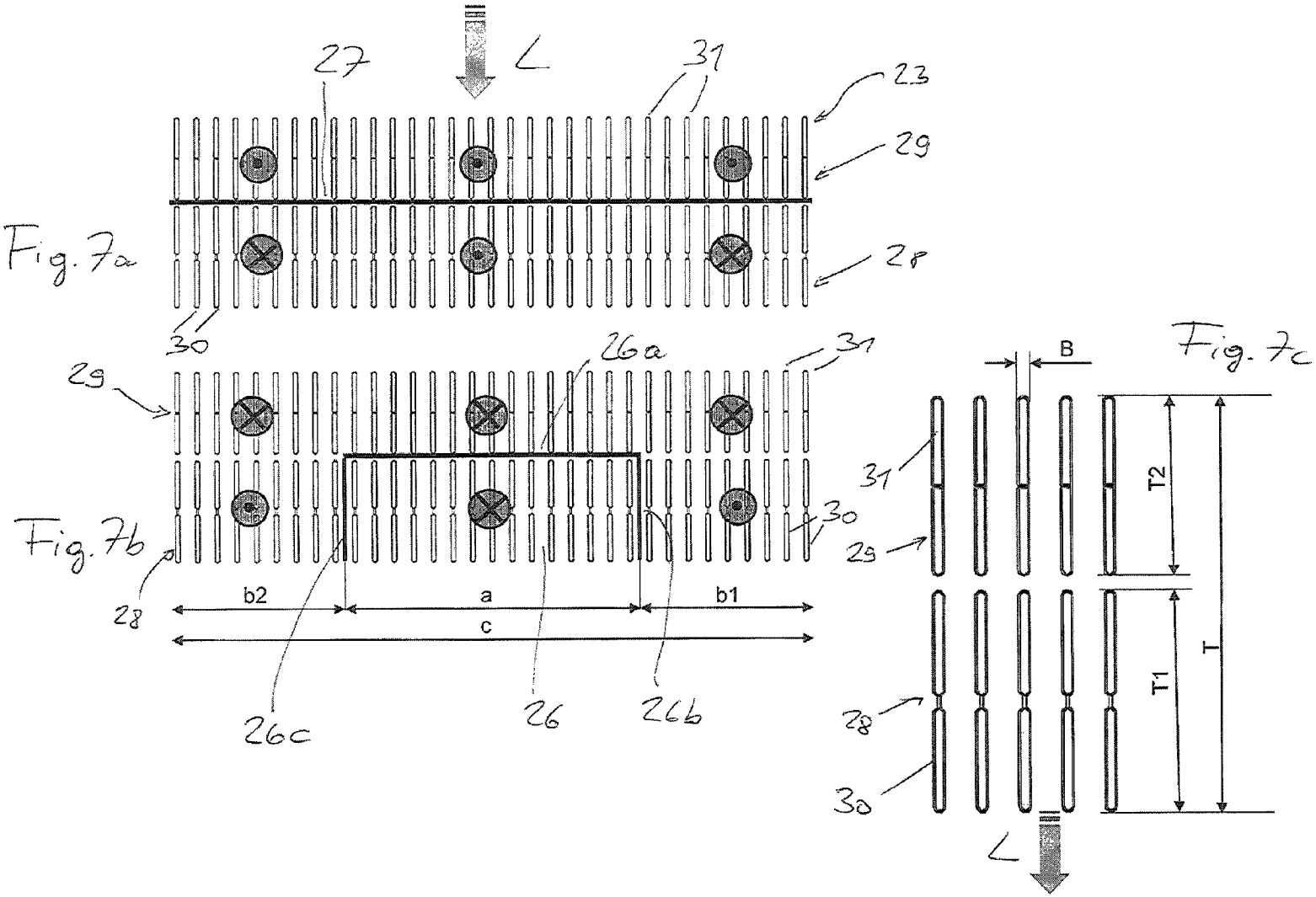
FIGS. 7*a*, 7*b*, 7*c* show views from above and below of the heater block, and an enlarged depiction of the heater tubes.

FIG. 7*a* shows a view from above of the heater block 23 corresponding to FIG. 5*a* through FIG. 6*b*. The block 23 has two rows 28, 29 of two-chambered tubes 30, 31. The flow direction of the coolant is again indicated by dot and cross symbols. The direction of air flow is shown by an arrow L. Indicated between the two tube rows 28, 29 is the longitudinal baffle 27.

FIG. 7*b* shows a view of the heater block 23 from below, with the first tube row 28 and second tube row 29, and with the inlet region 26 (first region) and baffles 26*a*, 26*b*, 26*c*. The number of tubes in the individual regions, which is to say in the first and second regions, and in the second row 29, are indicated by the arrow heads a, b1, b2, c. The number of tubes shown in the drawing or the dimensional relationships correspond to a preferred example embodiment, in which fifteen tubes 30 are provided in the first region a, and nine tubes are provided in each of the second regions b1, b2. In this way, after the redirection in width an enlargement of the flow cross-section occurs in the second regions b1, b2, so that a delay of the coolant flow takes place in the tubes 30 with the dot symbol. This is desirable because of the cooling of the coolant from region a to the regions b1, b2. The following relationship applies: $a \leq (b1+b2)$.

FIG. 7*c* shows an enlarged view of the tubes 30, 31 from the first row 28 and second row 29, wherein the depth dimensions T1 apply for the tubes 30, T2 for the tubes 31, and T for the overall block depth. The width of the tubes is labeled B. The drawing is dimensionally accurate for a preferred example embodiment, which is to say that the depth dimension T2 of the second row 29 is smaller than the depth dimension T1 of the first row 28. The number of tubes 30, 31 in the two rows 28, 29 is identical, just as in FIGS. 7*a*, 7*b*. The entire flow cross-section of the tubes 31 in the second row 29 is dimensioned in such a way that an additional delay in the coolant flow results after the redirection in depth. In this way, an increased temperature difference is achieved on the air inlet side, and thus a gain in performance. According to a preferred example embodiment, the depth dimension T2 is selected in a range from 0.5 T1 to 1.0 T1.

According to a preferred embodiment, the inventive heaters or their flat tubes have the following dimensions: The tube width B is in a range from 0.5 to 4.0 mm, preferably in a range from 0.8 to 2.5 mm. The material thickness (tube wall thickness) s of the flat tubes is in a preferred range of 0.10 to 0.50 mm. The depth T of the block (so-called wetted depth) is in a range from 10 to 100 mm, preferably in a range from 20 to 70 mm.

Due to the stepwise expansion of the flow cross-section after each redirection in width and/or redirection in depth, there also results, in conjunction with the delay in the coolant flow, a smaller pressure drop on the coolant side, which reduces the power requirement for the coolant pump.

Figure 8:
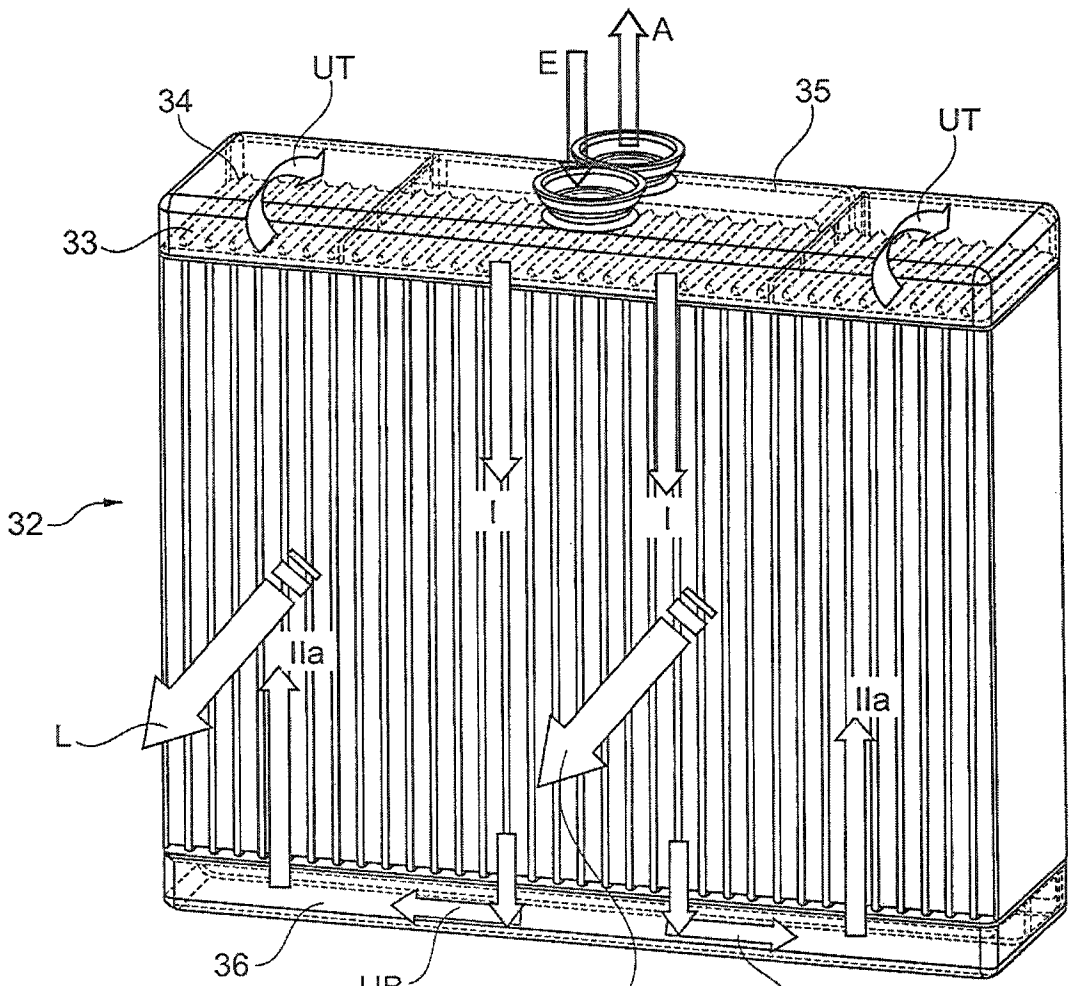
FIG. 8 illustrates an additional example embodiment of the invention, a heater with "double" redirection in width, i.e., in the first and second row.

FIG. 8 shows another example embodiment of the invention in the form of a two-row heater 32 in which the coolant is redirected in width in both the first and second row of tubes. The coolant's entry into the heater 32 is indicated by an arrow E and the coolant's exit from the heater 32 is identified by an arrow A. The direction of air flow through the heater 32 is indicated by two arrows L, which is to say the air and coolant are directed in cross-counterflow to one another. The heater 32 has a first, leeward-side row of tubes 33 and a second, windward-side row of tubes 34, as well as an upper header tank 35 and a lower header tank 36 in which the tube ends (not labeled with reference numbers) terminate. The coolant first enters an inlet region, identified by arrows I, in the first row of tubes 33, is redirected outward in width in the lower header tank 36, corresponding to the arrows UB, enters the two outer subregions, flows through them from the bottom to the top, corresponding to the arrows IIa, IIb, and is redirected in depth in the upper header tank 35, corresponding to the arrows UT. In the rear, windward-side row of tubes 34, flow from the top to the bottom occurs—which is not shown here—followed by another redirection in width, flow from the bottom to the top, and finally the exit of the coolant, indicated by the arrow A. As is shown and explained in greater detail in the subsequent figures, the flow through the regions I, IIa, IIb takes place in opposite directions in the front and back rows 33, 34.

Figures 9A, 9B:
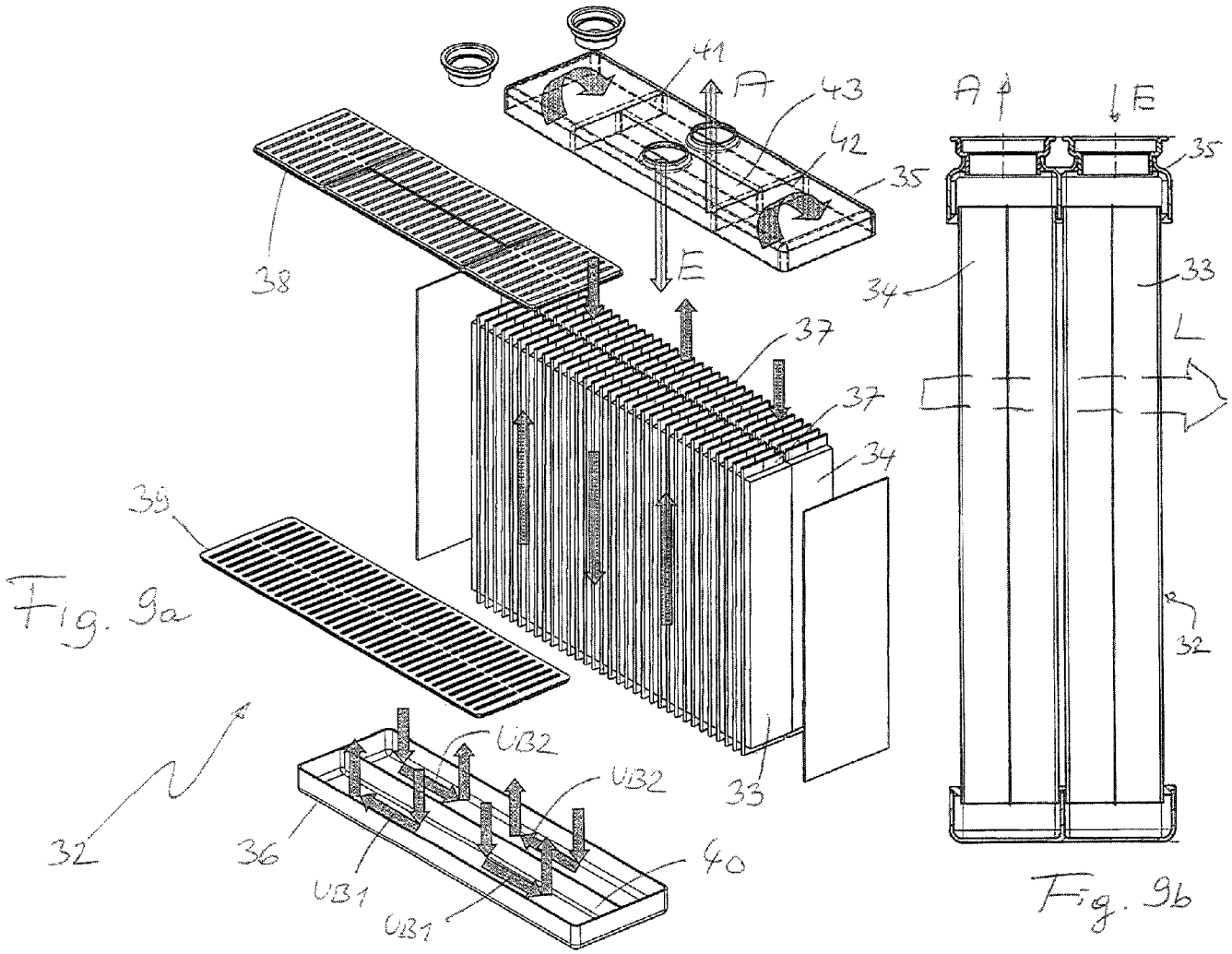
FIG. 9*a* shows the heater from FIG. 8 in an exploded view.
FIG. 9*b* shows the same heater in cross-section.

FIG. 9*a* shows the heater 32 from FIG. 8 in an exploded view, with the same reference numbers being used for the same parts. The flow of the coolant is indicated by arrows in the tubes and the header tanks 35, 36. Both rows of tubes 33, 34 have a plurality of flat tubes 37, between which are located corrugated fins that are not labeled with reference numbers. The ends of the flat tubes 37 are joined to tube plates 38, 39, preferably by soldering. The tube plates 38, 39 are joined to the header tanks 35, 36, preferably by soldering. Located in the lower header tank 36 is a longitudinal baffle 40, which separates the first and second rows of tubes 33, 34 so that a redirection in width can take place for each of the first and second rows of tubes 33, 34 in the lower header tank 36, as shown by the arrows UB1, UB2, in the opposite direction in each case. Located in the upper header tank 35 are two transverse baffles 41, 42 extending across both rows of tubes, as well as a longitudinal baffle 43 extending between the transverse baffles 41, 42. The flow path of the coolant shown by the arrows is a result of this arrangement of the baffles 40, 41, 42, 43. In the vertical direction, which is to say within the flat tubes 37, the coolant flows in the opposite direction in the first and second rows 33, 34, and also in the lower header tank 36. There, a redirection in width from the inside to the outside takes place in the first row 33, while a redirection in width from outside to the inside takes place in the second row 34.

FIG. 9*b* shows the heater 32 in a cross-sectional view in which can be seen the two rows of tubes 33, 34, the two header tanks 35, 36, the entry of the coolant indicated by an arrow E, the exit of the coolant indicated by an arrow A, and the direction of flow indicated by an arrow L. The counterflow principle is clearly evident here.

Figure 10C:
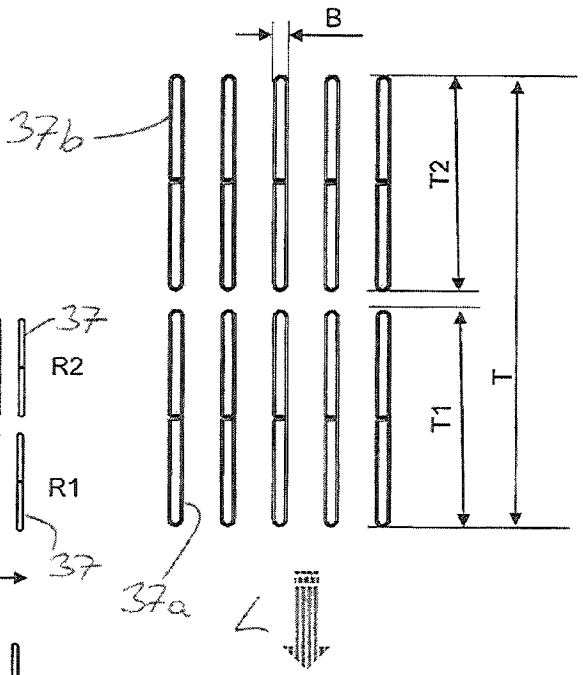
FIGS. 10*a*, 10*b*, 10*c* are views from above and below of the tube ends of the heater block.
Figure 10A:
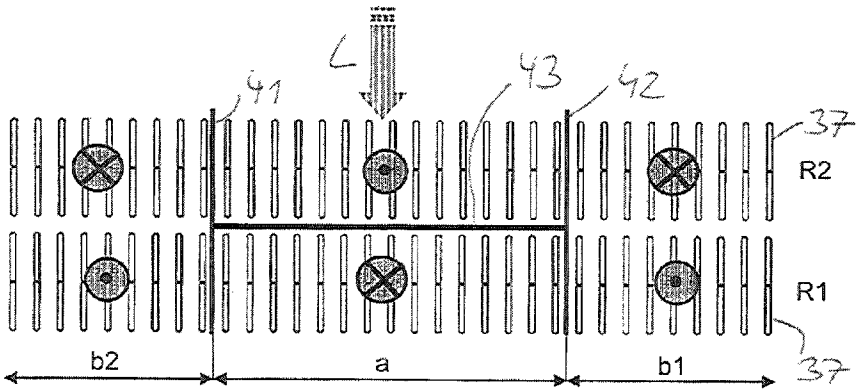
Figure 10B:
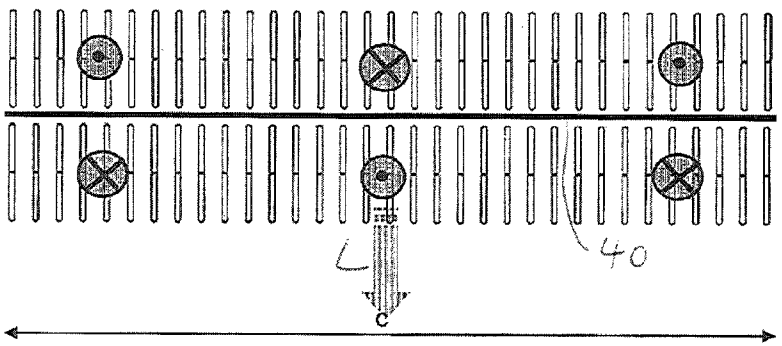

FIGS. 10*a*, 10*b*, and 10*c* show top views of the tube ends, as well as the numbers and dimensions thereof. Once again, the same reference numbers are used for identical parts. FIG. 10*a* shows a top view (view from above) of the two rows of tubes 33, 34—here called R1, R2. Together with the longitudinal baffle 43, the two transverse baffles 41, 42 form an H shape. The direction of the coolant's flow through the flat tubes 37 is indicated by dot and cross symbols. The number of tubes in the individual sections of the rows of tubes R1, R2 is represented by the subsections a, b1, b2, c. In order to achieve a delay in the coolant flow after the first redirection in width, the sum of the tubes b1 and b2 is larger than the number of tubes a, which is to say that (b1+b2)>a. With respect to the example embodiment in FIG. 10*a*, the section a has fifteen tubes and the sections b1 and b2 each have nine tubes, so that as a result, the flow cross-section increases by three tube cross-sections. This produces a reduction in the flow velocity in the sections b1 and b2. After the redirection of the coolant in the row R1, it flows upward in the subregions b1 and b2 (dot symbol) and then is redirected in depth—opposite the air flow direction L—which is to say into the row R2, where it again flows downward (cross symbol).

FIG. 10*b* shows a view from below of the tube ends of the rows of tubes R1 and R2, between which is located the longitudinal baffle 40. The overall width of the rows of tubes R1, R2 is indicated by c; this region is not subdivided by baffles, so that a redirection in width can take place in both the rows R1, R2.

FIG. 10*c* shows an enlarged section of the two rows of tubes R1, R2, each with five flat tubes 37*a*, 37*b* whose extent in depth (in the direction of air flow) is labeled with T1 and T2. The overall depth of the two rows of tubes (of the block) is labeled T. In order to achieve an additional delay of the coolant flow in the second row R2 as well, which is to say after the redirection in depth, the depth T2 of the flat tubes 37*b* can be chosen larger than the depth T1 of the flat tubes 37*a*—while retaining the same tube width B and same number of tubes.

For a preferred example embodiment, the tube width B is in a range from 0.5 to 4.0 mm, preferably 0.8 to 2.5 mm. The material thickness of the flat tubes 37*a*, 37*b* is in the range from 0.10 to 0.50 mm. The installation depth T (wetted or block depth) is 10 to 100 mm, preferably 25 to 70 mm. In the drawing, two rows of flat tubes 37*a*, 37*b* are shown which are designed as two-chambered tubes. However, multi-chambered tubes or even a single-row construction with a continuous flat tube which has a baffle (bead) approximately in the center region are also possible.

Figure 11:
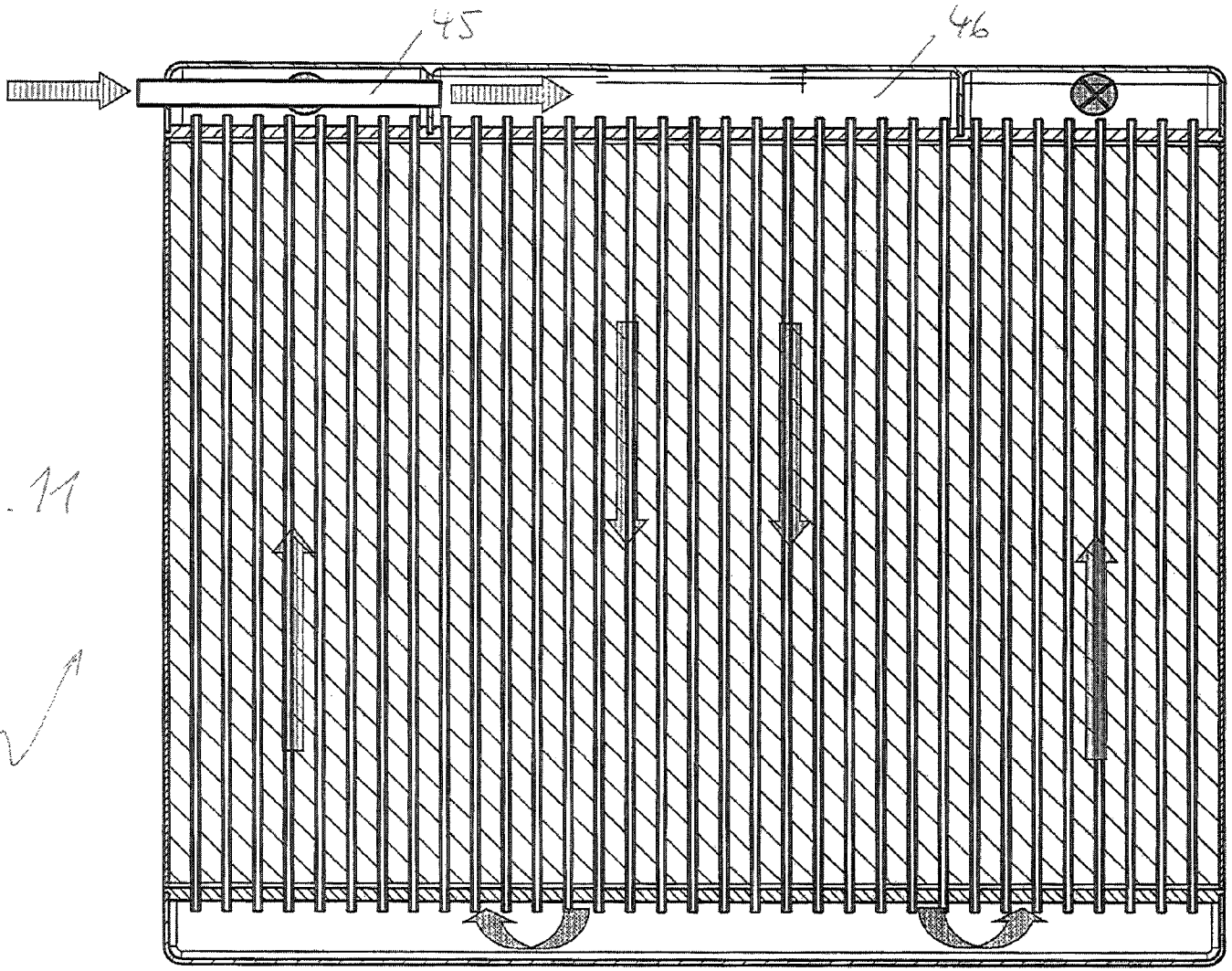
FIG. 11 is as an additional example embodiment of the invention, a heater with coolant connection on the side.

FIG. 11 shows another example embodiment of the invention with a heater 44, which corresponds to the example embodiment from FIG. 10*a*, 10*b* in terms of the flow pattern. A design variant provides for lateral inflow of the coolant through an admission tube 45, by which means the coolant is brought from the outside to the center flow region 46. In similar fashion, an outlet tube (not shown) can be provided for the outlet region located behind the flow region 46 in the plane of the drawing. A laterally arranged coolant connection of this nature can be advantageous on account of the installation situation in the motor vehicle.

Figure 12:
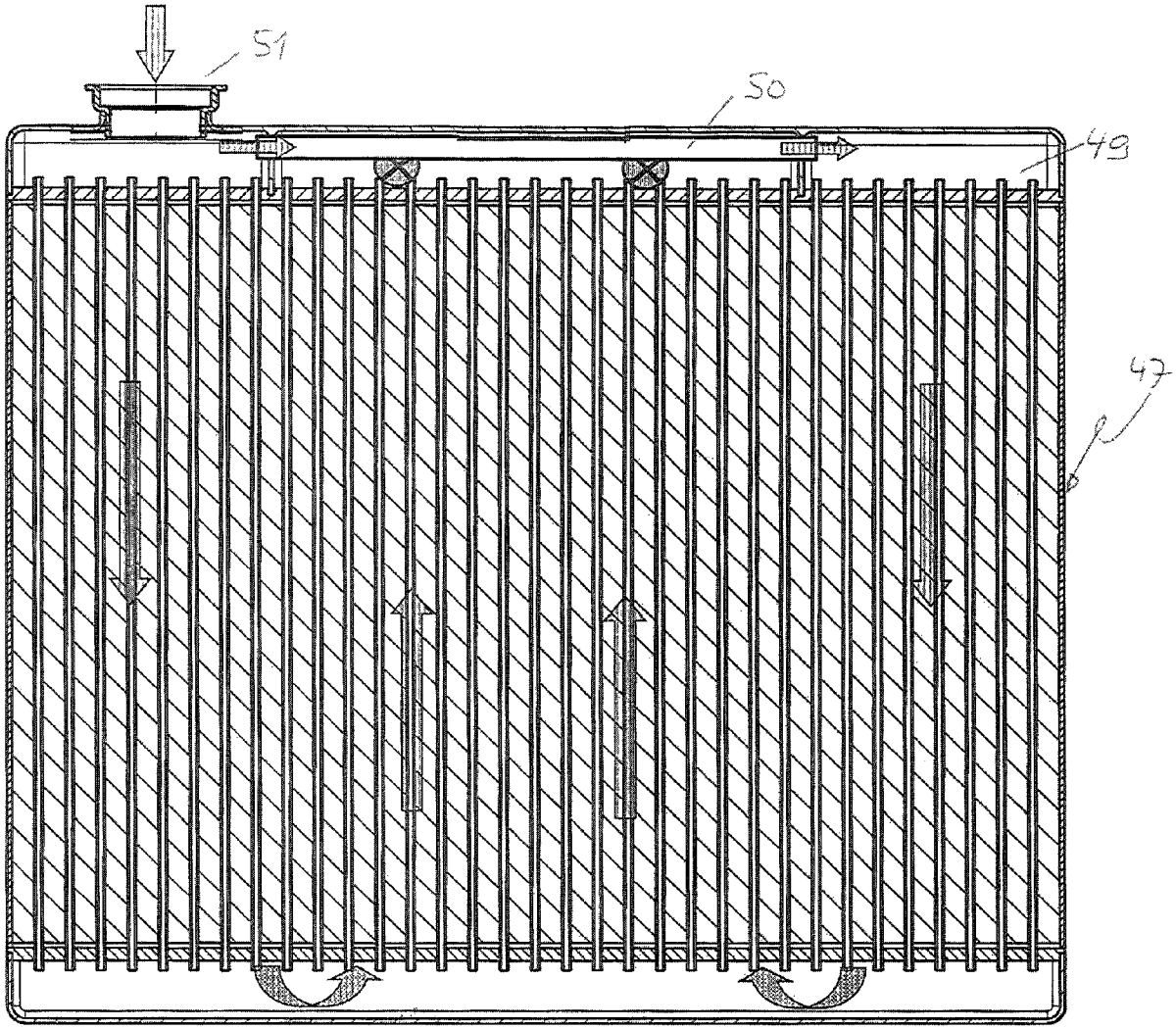
FIG. 12 shows an additional example embodiment of the invention, a heater with outer inlet regions.

FIG. 12 shows another example embodiment of the invention with a heater 47 which has inflow regions 48, 49 (subregions) located on the outside that communicate with one another through a connecting pipe 50. The coolant entering through the inlet connection 51 is thus distributed to both inflow chambers 48, 49. The situation on the outflow side, which is to say in the second row of tubes, is similar, although it is not shown.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A heat exchanger comprising:

at least two rows of flow channels through which a liquid medium is adapted to flow, the flow channels of the at least two rows of flow channels having longitudinally spaced first and second ends;

an inlet header connected to the first ends of the flow channels of the at least two rows, the inlet header having an inlet;

an outlet header connected to the second ends of the flow channels of the at least two rows, the outlet header having an outlet;

secondary surfaces located between the flow channels over which air is adapted to flow, wherein the liquid medium and the air are directed in cross-counterflow and a first row is located on an air outlet side and a second row is located on an air inlet side, and wherein the liquid medium enters a first region of the first row from the inlet header and is redirected in the outlet header into a second region of the first row and is redirected in the inlet header into the second row from the second region of the first row, and exits the outlet of the outlet header after passing in a single direction through the second row.

2. The heat exchanger according to claim 1, wherein the liquid medium is redirected at least once within the second row.

3. The heat exchanger according to claim 1, wherein the first region is located in a center, and wherein the second region comprises two subregions that are symmetrically arranged on both sides of the first region.

4. The heat exchanger according to claim 1, wherein the first region is located off-center and the second region is located next to the first region.

5. The heat exchanger according to claim 1, wherein the first region comprises two subregions, and wherein the two subregions are located outside and the second region is located between the subregions.

6. The heat exchanger according to claim 5, wherein the two subregions communicate with one another on the inlet side via a connecting pipe.

7. The heat exchanger according to claim 2, wherein the second row has two outer subregions and a center outlet region, and wherein the liquid medium is redirected out of the two subregions from the outside to the inside and into the outlet region.

8. The heat exchanger according to claim 5, wherein the second row has two outer subregions and a center region, and wherein the liquid medium is redirected from the center region into the two subregions from the inside to the outside.

9. The heat exchanger according to claim 8, wherein the subregions communicate with one another on the outlet side via a connecting pipe.

10. The heat exchanger according to claim 1, wherein the flow channels are flat tubes.

11. The heat exchanger according to claim 1, wherein the heat exchanger is a heater of a heating or air conditioning system of a motor vehicle, and wherein the heater has chambers for the inlet or outlet and/or a redirection of the liquid medium or coolant, respectively.

12. The heat exchanger according to claim 11, wherein baffles, in particular transverse and/or longitudinal baffles are located in the chambers.

13. The heat exchanger according to claim 1, wherein each region of flow channels has a region-specific flow cross-section, and wherein the flow-cross sections are changeable after a redirection.

14. The heat exchanger according to claim 13, wherein the flow cross-sections become stepwise larger in the flow direction of the coolant so that the flow velocity of the coolant is reduced.

15. A heat exchanger comprising:

a core having a given width and defined by a first row of flow channels configured to carry a liquid medium, the flow channels of the first row of flow channels being spaced along said width and having first and second longitudinally spaced ends and by a second row of flow channels configured to carry a liquid medium, the flow channels of the second row of flow channels being spaced along said width and having first and second longitudinally spaced ends;

an inlet header having an inlet and receiving the first ends of the first row of flow channels along a first side of the inlet header and receiving the first ends of the second row of flow channels along a second side of the inlet header;

an outlet header having an outlet and receiving the second ends of the first row of flow channels along a first side of the outlet header and receiving the second ends of the second row of flow channels along a second side of the outlet header;

secondary surfaces located between the flow channels of the first row of flow channels and between the flow channels of the second row of flow channels over which air is adapted to flow, wherein the liquid medium and the air are directed in cross-counterflow and the first row is located on an air outlet side and the second row is located on an air inlet side, wherein the inlet header includes a baffle configured to direct the liquid medium from the inlet header into a first subset of the first row of flow channels and to direct the liquid medium received from a second subset of the first row of flow channels to the first ends of the second row of flow channels, the inlet header being configured to allow the liquid medium received from the second subset of the first row of flow channels to flow into the first ends of all of the flow channels in the second row of flow channels, wherein the first subset of the first row of flow channels occupy a first proportion of said width, the second subset of the first row of flow channels occupy a second proportion of said width, the second row of flow channels occupy a third proportion of said width, and wherein a sum of the first proportion and the second proportion is substantially equal to the third proportion.

* * * * *